United States Patent [19]

Henriksen et al.

[11] 4,422,390

[45] Dec. 27, 1983

[54] PROCESS AND APPARATUS FOR COLLECTION OF GASES AND PARTICULATES IN A FURNACE FEED SYSTEM

[75] Inventors: Arthur J. Henriksen, Pocatello, Id.; Klaus F. Thiel, Foster City, Calif.; Carl F. Peterson, Pocatello, Id.

[73] Assignee: FMC Corporation, Philadelphia, Pa.

[21] Appl. No.: 346,826

[22] Filed: Feb. 8, 1982

Related U.S. Application Data

[62] Division of Ser. No. 169,248, Jul. 16, 1980, Pat. No. 4,368,676.

[51] Int. Cl.[3] ..... F23B 7/00

[52] U.S. Cl. ..... 110/341; 110/101 CC; 110/101 CD

[58] Field of Search ..... 110/101 R, 101 A, 101 CC, 110/101 CD, 327, 293, 341; 266/158; 13/33; 432/65; 414/157, 170, 187

[56] References Cited

U.S. PATENT DOCUMENTS

| | | | |
|---|---|---|---|
| 1,376,971 | 5/1921 | Qualman . | |
| 1,666,027 | 4/1928 | Beaumont . | |
| 1,973,451 | 9/1934 | Unger . | |
| 2,289,538 | 7/1942 | Buford . | |
| 2,358,143 | 9/1944 | Castor . | |
| 3,173,980 | 3/1965 | Hysinger . | |
| 3,218,953 | 11/1965 | Grow et al. . | |
| 3,258,890 | 7/1966 | Dirkse . | |
| 3,392,489 | 7/1968 | Johnson et al. . | |
| 3,395,657 | 8/1968 | Schuss | 110/101 R |
| 3,440,022 | 4/1969 | Elmore . | |
| 3,453,369 | 7/1969 | Dock . | |
| 3,533,611 | 10/1970 | Boyer et al. . | |
| 3,859,933 | 1/1975 | Von Klenck | 110/216 X |
| 3,896,257 | 7/1975 | Kinoshita . | |
| 3,900,696 | 8/1975 | Tress et al. . | |
| 3,913,898 | 10/1975 | Wolters . | |
| 3,936,588 | 2/1976 | Asphaug et al. . | |
| 3,997,758 | 12/1976 | Patel . | |
| 4,088,824 | 5/1978 | Bosistalli . | |
| 4,089,640 | 5/1978 | Overmyer . | |
| 4,158,562 | 6/1979 | Mattioli et al. | 266/159 X |
| 4,177,716 | 12/1979 | Bowe et al. . | |
| 4,205,931 | 6/1980 | Singer et al. | 110/216 X |
| 4,348,968 | 9/1982 | Demar | 110/101 CD |

FOREIGN PATENT DOCUMENTS

| | | | |
|---|---|---|---|
| 224789 | 12/1962 | Austria | 110/173 B |

OTHER PUBLICATIONS

John R. Van Wazer–1961–p. 1132.

*Primary Examiner*—Edward G. Favors
*Attorney, Agent, or Firm*—Frank Ianno; Eugene G. Seems

[57] ABSTRACT

A process and apparatus are described for collection of gases and particulates which arise during the feeding of an electric furnace, especially in the manufacture of phosphorus. The collection system for the gases and particulates includes novel explosion panels which are employed in an enclosure that contains the gases and particulates, and the use of such panels also in the ductwork and filter units that conveys and treats the gases and particulates from the enclosure. A further treating system also prevents moisture in the gases and particulates from clogging the filters used to separate the particulates from the gases. Also described is a novel furnace feeding system that can be used in cooperation with the gas and particulate collection system.

3 Claims, 6 Drawing Figures

PROCESS AND APPARATUS FOR COLLECTION OF GASES AND PARTICULATES IN A FURNACE FEED SYSTEM

This application is a division of application Ser. No. 169,248, filed July 16, 1980 U.S. Pat. No. 4,368,676.

The present invention relates to a process and apparatus for the collection of gases and particulates which develop when handling friable materials which are subject to dusting during the feeding of these materials to a furnace. It has specific application in the process of producing elemental phosphorus wherein calcined phosphate agglomerates carbon and silica are used as the furnace feed and give rise to dust from breakdown of some agglomerates and carbon particles during the normal handling and transportation of these agglomerates to the furnace. In addition to the dust created by the breakage of the agglomerates and carbon, gases also are discharged from the furnace which, along with the dust, have to be collected and handled.

In conventional, known furnace operations wherein an ore is fed to a furnace and treated at high temperature to recover a mineral product, such as the production of elemental phosphorus, the collection and handling of both particulates and gases in a safe manner poses serious obstacles. In the operation of electrical furnaces, such as those employed in producing phosphorus, the ores mixed with carbon and silica are contained in feed bins located at some distance above the furnace, and feed chutes are used to convey the feed from the bins down into the furnace. In order to prepare the phosphate ore for use in the furnace, the ore is crushed, agglomerated by the briquetting, pelletizing, or sintering into compacted shapes, and the shapes are calcined where required to remove combustible and other gas producing elements from the ore. This procedure for preparing phosphate ore into briquettes suitable for use in a phosphorus furnace is described in U.S. Pat. No. 3,760,048 issued on Sept. 18, 1973 in the names of James K. Sullivan, et al.

Since the feed chutes from the feed bins are connected directly to the furnace, gases in the furnace can rise up through the chutes and into the feed bins. This arrangement is required to maintain a constant supply of feed on demand to the furnace, but it results in a number of problems that must be solved if a successful process and apparatus for collecting the gases and particulates is to be developed. An initial problem that arises therefrom is that when substantial variations in pressure develop in the furnace from gas evolution, these gases and resultant pressures are transmitted through the furnace feed chutes up to the feed bins. Since such gases released from the furnace must be collected along with dust that is developed within the feed bins, the collection process and apparatus must be sufficiently flexible to handle such wide variations in gas volumes without overloading the system.

A second reason for the development of undue and variable pressures in the furnace is brought about by what is termed the "cave-in effect" of furnace operation. This results when fines or fuzed particles form a crust or barrier within the furnace that holds up the continuous flow of feed to the furnace. This crust holds up the feed from migrating down into the furnace and being processed. When the crust or barrier breaks under the weight of the feed it must support, the sudden cave-in of large amounts of feed creates a large and sustained pressure surge. Under these circumstances, a conventional fan which has been designed to draw off the phosphorus and carbon monoxide gas stream for treatment and recovery cannot handle the magnitude of these surges. As a result, the excess gases pass up through the feed chutes and into the feed bins increasing the dust load and gas volume that must be collected and handled.

Another reason for the development of pressure variations in the furnace is due to the sealing effect which high amount of fines will create if they are present in the furnace or feed bins. The fines effectively form a gas plug which prevents uniform venting and control of gases which normally percolate from the furnace up through the furnace feed chutes and feed bins. The plug of fines causes a stopper effect in the furnace creating a buildup in pressure until the plug is ruptured and there is a rush of gas flowing past the plug and into the furnace feed chutes and feed bins, which gas flow must be handled.

Another serious cause for pressure variations in the furnace is due to the presence of water in the feed. Any such water which is present with the feed will flash as soon as it hits the high temperature of the furnace and results in the evolution of large volumes of gases. Water in the calcined agglomerates, in excess of that normally included in the manufacture of the agglomerates, can be present because of condensation of water vapor on the surface of the agglomerates, or because water has been added to the agglomerates to cool them. In this latter situation the agglomerates, after being calcined, must be cooled before they can be put on conveyor belts and transported. If the cooling section of the calciner does not cool the agglomerates, it becomes necessary at times to apply water to the surface of the agglomerates to cool them sufficiently before they are placed on a conveyor belt, since their otherwise high temperature would scorch or disable the conveyor belt used to transport the calcined agglomerates. On occasion, water can also be introduced into the interior of the furnace due to inadvertant rupture of the water-containing equipment which spills its water into the furnace, e.g., water cooled tapping areas.

Another problem which arises in this collection system is that the gases which are vented from the furnace through the furnace feed chutes and feed bins contain substantial amounts of carbon monoxide. The concentration of this gas must be kept within specified limits to prevent explosive gas mixtures from forming in the collection and conveying equipment. Also the presence of carbon monoxide means that this gas can burn even at low concentrations within the bins or the feed chutes resulting in fused agglomerate briquettes that can cause pluggage or blockage of the free flow of feed to the furnaces. This can be avoided by properly venting the gas from the feed bins continuously so as to avoid any buildup of carbon monoxide concentrations which will permit burning of the gases to take place in the bins or concentrations of carbon monoxide to build up to a point where they form explosive gas mixtures.

Still another problem which arises in this area is that the gases which are vented from the furnace and up through the furnace feed chutes and feed bins are very high in temperature since the furnace is operated at extremely high temperatures, e.g., about 350° C. The temperature of these gases must be maintained below that at which operation of filters, particularly paper or cloth baghouses, can be carried out without being subject to damage or destruction by virtue of the excessive heat. These gases which are collected above the feed bin can reach high temperatures, not only because they are hot when they emanate from the furnace, but also because they can be heated by combustion of carbon in the feed bins or by combustion of either carbon monoxide and/or elemental phosphorus, which gases may also be present in those passing upwardly through the feed bins.

Another most difficult problem that arises in the gas collection process is brought about because the particles of phosphate dust that are being conveyed to the filters for collection, and particularly baghouses designed to handle large volumes of gases, contain water. As a result the filters in the baghouses or other dust collecting means become plugged with wet mud formed by the mixture of dust and water, which stops the free flow of gases through these filters or baghouses, requiring replacement of the filtering units. This problem persists even though water which is present in the feed bins from the feed is as little as 0.6 up to 3% by weight based on the weight of the feed. Control of this moisture problem which causes filter blinding is particularly difficult since the gas stream, from the point of collection to the point where it is filtered in the baghouses, flows through the collection and conveying equipment in only a few seconds. Accordingly, any treatment of the gas stream must be effected in an extremely short time in order to succeed.

Still another problem that presents itself is the design of a collection system that is safe. As set forth above, it is necessary to limit the concentrations of carbon monoxide in the gas stream being collected and handled. However, in addition to this requirement the system must have backups which would inhibit any shock waves resulting from uncontrolled burning from traveling through the system and causing injury to personnel or damage to the collection and conveying equipment. While blow-out panels with shear bolts and rupture discs which will yield under specified pressures are known, these do not provide explosion panels which will open under the low pressure required in the present situation, i.e., 0.75 psig$\pm$0.25 psig. Accordingly, an entirely new system is required to relieve pressures in the collection and gas transporting equipment utilized in the present invention.

Additional problems have arisen in efforts to maintain uniform furnace operations in order to maintain a more steady rate of gas flow from the furnace. These include the need for an improved feed system for the furnace to cooperate with the dust and gas collection system that was required. The furnace feed system is important because it must keep the furnace feed chutes full of furnace feed material and maintain the furnace feed in the feed bins at a high level of fill. When the feed bins and pressure feed chutes are full, gases from the furnace cannot readily escape out of the furnace through the chutes and bins without percolating through the bed of feed particles contained in the chutes and the bins. The resulting contact between the gases and the feed both cools the gases and moderates their rate of escape from the furnace because of the resistance to flow which the bed of feed particles provides to the flow path of the rising gases.

Prior feed systems often utilized conventional manual dump techniques in which a chute or a conveyor is manually placed over the feed bin and the feed is allowed to tumble or run down a slide into the feed bin until the operator considers it to be full. The system is inaccurate in defining the level of feed in the feed bin because the operator generally cannot see the level of feed in the bin because of the large volumes of dust and gases that rise from the bin during the loading operation. Further, this feeding system is unable to detect any blockages in the furnace feed chutes because the operator is unable to see or measure whether the chutes contain feed, even when the feed bin is full.

It has now been found that the above deficiencies in prior art systems can be overcome by the present furnace feed system when used in combination with the instant gas and particulate collection system. The gas and particulate collection system also includes novel explosion panels which are employed in the feed bin enclosure, to be described, which collects the gases and particulates. These panels are also present in the ductwork from the feed bin enclosure to a dust filter unit, and in the dust filter unit itself. These areas are protected by mounting explosion relief panels to function as safety panels and avoid damage to the system, or to a spread of damage throughout the system, for any uncontrolled burning that may take place in any part of the system. The panels function by relieving the pressure at strategic locations in the system, thereby preventing the spread of shock waves throughout the collection apparatus.

BRIEF DESCRIPTIONS OF THE DRAWINGS

Figure 1:
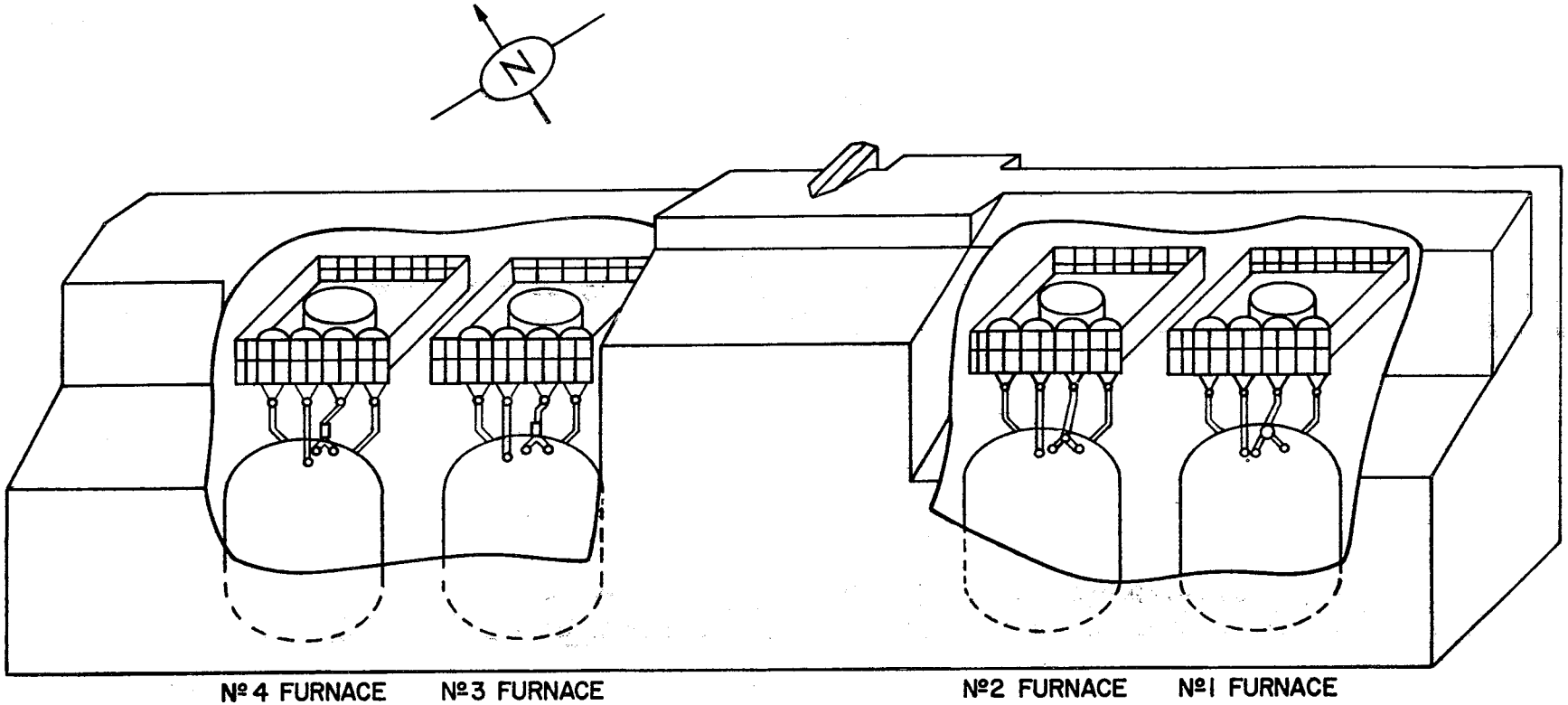
FIG. 1 illustrates the plant layout for a four furnace installation, including feed bins and feed bin enclosures.
Figure 2:
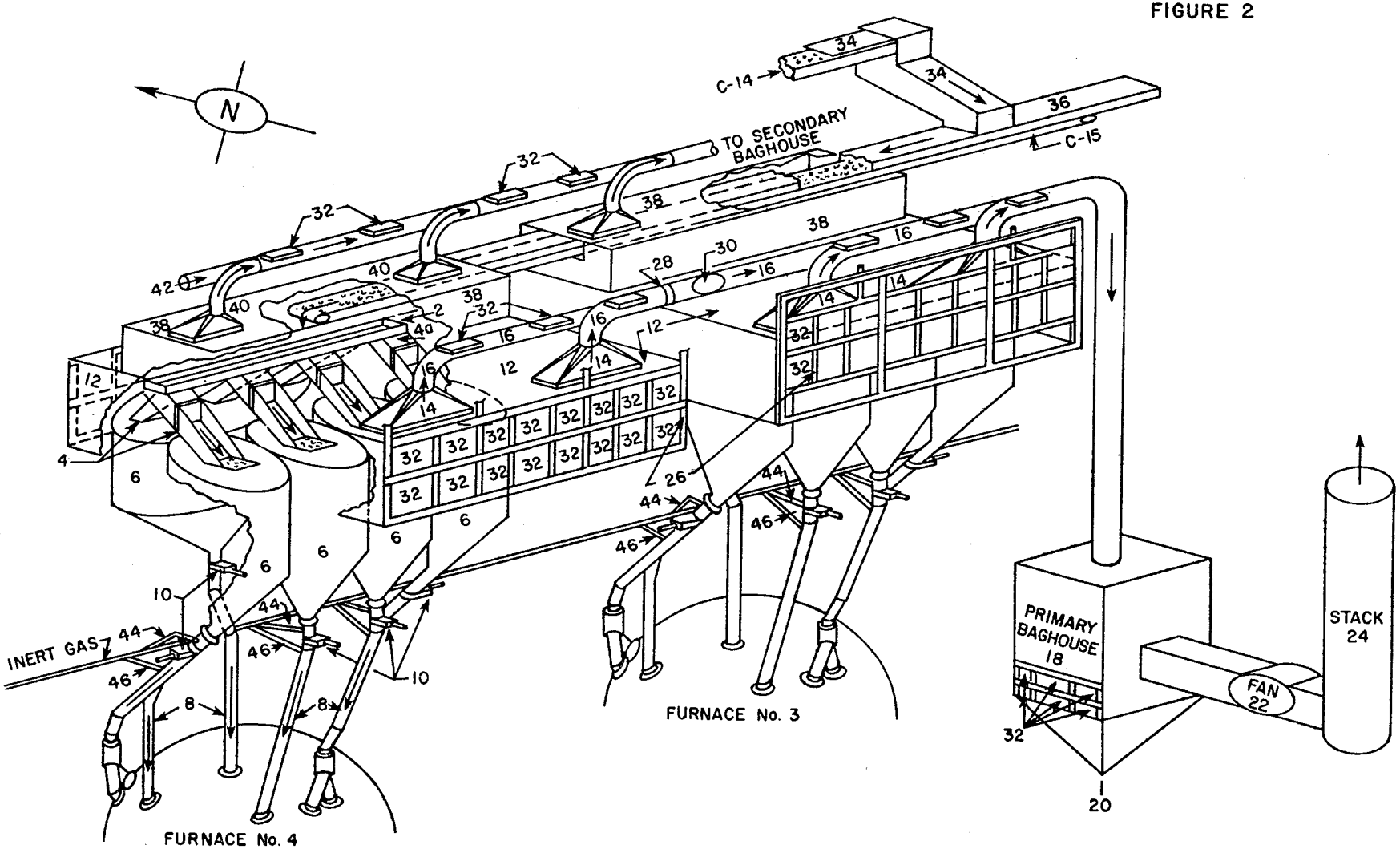
FIG. 2 illustrates the present system, including the furnace feed system, and gas and particulate collection system for one of four furnaces. Since the additional systems are essentially duplicates of the illustrated system and are used to feed and service the remaining three additional furnaces, no attempt will be made to show these in detail.

The present invention can best be described with reference to the attached drawings. In FIG. 1 of the drawings, there is shown a schematic for four phosphorus furnaces aligned from east to west with the furnace at the far easterly location being Furnace No. 1 and the furnace at the far westerly location being Furnace No. 4. FIG. 2 illustrates in detail the furnace feed system and the gas and collection system for furnace No. 4. Since all of the furnaces are identical for practical purposes as are their feed mechanisms, the details thereof have only been shown with respect to furnace No. 4. These illustrated embodiments are duplicated in furnaces No. 1, 2, and 3 in all details except that the furnace feed conveyor system is made up of only the illustrated conveyors which service all four furnaces.

The feed to the furnaces, in this case calcine phosphate agglomerates, carbon (coke) and silica are removed from their respective storage bins and transported to conveyor C-14 which is part of the conveying system. In normal operations it is customary to conduct a weight check of the total material which is being loaded on conveyor C-14 to monitor the furnace feed rate. Conveyor C-14 terminates at a position between furnace No. 3 and furnace No. 2 and deposits its feed material at a continuous rate onto reversible shuttle conveyor C-15. Conveyor C-15 is long enough to reach from the transfer point of feed from conveyor C-14 onto C-15 to the last feed bins of either furnace No. 4 or furnace No. 1. In practice, conveyor C-15 is a lengthy conveyor, on the order of 216 feet, and the direction of travel of the conveyor is reversible. Conveyor C-15 is also mounted so that the entire shuttle conveyor can be moved easterly or westerly over any of the feed bin chutes and fill any of the feed bins in the four furnaces. As shown in FIG. 2, the reversible shuttle conveyor C-15 is positioned above one of the feed bin chutes 4 and feed material which is delivered onto conveyor C-15 from conveyor C-14 travels on top of conveyor C-15 and falls into one of a series of seven chutes 4 located above each furnace feed bin 6. These feed bin chutes 4 in turn convey the feed to feed bins 6 which are located below and on either side of the shuttle conveyor C-15. The upper end of the feed bin chutes 6 are all aligned and each can be fed by conveyor C-15 when the end of the conveyor C-15 is above and aligned with the top of any designated feed bin chute 4. A counterweighted hinge plate (not shown) is installed in the top end of each chute 4 to reduce the possibility of carbon monoxide or fire entering the shuttle conveyor area.

The feeding procedure for the C-15 shuttle is directed by a programmable controller (not shown) which is the primary automatic controlled mode, that is Mode I, carries out the following steps in sequence. For ease of understanding we will review the feeding of the feed bins in furnace No. 3 and furnace No. 4 which are on the west side of the plant and wherein the feed system for No. 4 is illustrated in detail in FIG. 1.

Once every seventy-five minutes the reversible shuttle conveyor C-15 is positioned above the top of the first cast feed bin chute 4*a* over the No. 3 furnace. This chute is the closest to the C-14 conveyor which continually discharges its feed material onto conveyor C-15 between furnace No. 2 and furnace No. 3. The C-15 conveyor belt moved feed in a westerly direction and deposits the feed in the first chute 4*a* from the west end of the conveyor C-15. When this bin becomes full, the C-15 shuttle moves west into a position above the second chute 4 which is adjacent to the first chute 4*a* that has been filled. The second chute 4 is then filled. The C-15 conveyor is positioned above each chute by means of a proximity switch which signals the programmable controller. Each of the seven feed bin chutes 4 is then filled in order with the C-15 shuttle always moving westwardly, until the seventh chute 4G (most westerly) of No. 3 furnace has been filled. Since the seven feed bin chutes 4 of each furnace have a common trough 2, the feed does not have to be halted when moving shuttle C-15 between these adjacent chutes.

It should be noted that the traversing motion of the shuttle C-15 when the belt is loaded is always away from the discharge chute at the point of transfer from conveyor C-14. This arrangement is mandatory since it prevents any jam-up of feed because the loaded shuttle belt never moves toward the C-14 discharge chute.

When the last bin 4G in No. 3 furnace has become full, the feed is automatically stopped and the C-14 and C-15 conveyors are cleared of material by permitting the residual feed to be deposited in the last bin 6 of the No. 3 furnace. The level sensor on this last No. 3 feed bin 6 is installed lower than on the other bins to allow the remaining material on the C-14 and C-15 conveyors to be deposited into the last bin 6 without overfilling.

As soon as the feed material is emptied from the conveyors, the C-15 reversible shuttle conveyor is moved west to a position over the top of the first feed bin chute 4*a* on No. 4 furnace. The feed bin chute 4*a* would be the most easterly of the chutes in No. 4 furnace. The feed is then automatically restarted and the filling process is repeated for each bin chute 4 of this furnace until the last bin chute 4G has been filled and the conveyors C-14 and C-15 are emptied again. When the last feed bin chute 4G of furnace No. 4 has been filled and all remaining feed on both conveyors has been removed, the entire shuttle C-15 is moved eastwardly until the other (east) end of the C-15 shuttle is positioned above the first west feed bin chute 4G on No. 2 furnace. At this point the direction of movement of the conveyor on the reversible shuttle conveyor C-15 is reversed and feed material which is deposited on the conveyor C-15 from the feed conveyor C-14 flows eastwardly to the end of the C-15 conveyor and is deposited into the top of the first west feed bin chute 4G. After the first bin chute 4G has been filled, the shuttle moves eastwardly to the top of the second feed bin chute 4 and commences filling this chute next. The same procedure is followed as was used in filling furnaces 3 and 4 except that the conveyor moves eastwardly instead of westwardly as in the case when furnaces 3 and 4 were being filled and the first feed bins filled are 4G and the last filled are 4*a*. The normal time required for filling the four furnaces is about 40 minutes out of each 75 minute cycle programmed into the controller.

As soon as the last bin of No. 1 furnace 4*a* (furthest bin to the east) becomes full, the feed is automatically halted and C-14 and C-15 conveyors are stopped after all material has been cleared. At the start of the next 75 minute cycle, C-15 conveyor moves westerly to the first chute 4*a* over furnace No. 3 and the whole cycle is repeated again. This automatic feed sequence, which is termed Mode I, maintains the feed bins within the range of 88% to 100% of their capacity, and on average above 90% of their capacity.

Nuclear level sensors (not shown) are installed on each furnace feed bin to indicate the high and low burden levels in the bin and also the low-low level in the furnace feed chute 8. These sensors are interlocked with the programmable controller. In addition to these sensors a high-high level sensor is located on each of the seven bin feed chutes 4 which are present in each furnace. The function of this high-high level sensor is to detect a plugged feed bin condition, which indicates that feed being placed into the top of the chutes 4 through common trough 2 are not flowing down the feed bin chutes 4 and into the feed bins 6.

The other function of the high-high level sensor is to detect a feed bin overfill condition which can occur if the high level sensor in the feed bin 6 malfunctions. The high level sensor in the feed bin 6, through the programmable controller, automatically moves the shuttle conveyor C-15 to the next chute 4, when the chute 4 being filled is indicated as being full by this high level sensor. Further, the high level sensor also shuts off the feed and moves the shuttle coneyor C-15 to the next furnace when the final chute 4*a* or 4G to be filled in a furnace has been completed. At that point the shuttle conveyor C-15 must be moved to the next furnace to commence filling the bins 6 in that furnace through the seven feed bin chutes 4 in sequential order. The low level sensor, which is located about midpoint in the feed bins 6, is only used to signal that the bin is about half full. In normal operations, the low level sensor is not reached in order to keep the feed bins 6 as full as possible. This assures maximum furnace operating time in case of feeding interference, more resistance to the flow of furnace gases through the bins, and less chance of material segregation and feed degradation due to excessive feed level fluctuations. The low-low level sensor, which is located in the furnace feed chute 8 below the knife valve 10 controls and actuates the knife valve 10 in the feed chute 8. When the feed bin low-low level switch is activated, the knife valve 10 is closed to prevent furnace gases from continuing to rise through the feed chutes 8 and into the bin 6 in order to avoid commencing bin fires which result from the hot gases and ignition of the carbon monoxide which may be present in these gases. The knife valve 10 will open again when the empty feed bins 6 (and furnace feed chute 4) are refilled and actuate the high level sensor with feed material, indicating that the bin 6 is full, or until manual operation has relieved a feed blocking condition.

The normal feeding sequence of conveyor C-15 which is the automatic feed sequence was described above as Mode I. In addition, two other modes are also possible. In Mode II, the programmable controller responds to a signal received from a low level switch. The conveyor C-14 stops with the feed still on it. Reversible shuttle conveyor C-15 discharges its feed load in the last bin 4*a* or 4G of the group. C-15 shuttle then moves to the bin group requiring attention and commences charging this bin group until it is filled with feed. C-15 then moves to the bin group previously being filled and the operation returns to Mode I in the normal sequence.

In Mode III, the programmable controller will respond to a signal received from a low-low level switch (furnace feed chute is empty), by stopping conveyor C-14 with feed on it and emptying the reversible shuttle conveyor C-15 in the last bin 4*a* or 4G of the group it has been filling and moving directly to the feed bin experiencing a low-low level feed signal in the furnace feed chute 8. Shuttle C-15 then proceeds with refilling of the feed bins 6 in that low-low level bin group before returning to the furnace it was previously feeding. However, if an alarm signal is received by the programmable controller from a low-low level switch without a prior signal from a low level switch, this would indicate that an impediment to feeding, sometimes termed a bridging condition, exists in that particular bin and no action will be taken by the automatic controller. In this situation the bridging (blockage to normal feeding) would have to be corrected before the unit could go back on automatic controller in its normal Mode I automatic feed sequency. Of course, manual override of the feed sequence is always possible which allows the operator to initiate feeding of any bin by direct manual control of the conveyor system and relocation of the reversible shuttle conveyor C-15 over any specific feed bin chute which the operator desires to fill.

In order to collect the gases that are evolved from the furnace through the feed bin chutes 4 and feed bins 6 and also particulates that are given off during charging of the feed bins 6, a single feed bin enclosure 12 surrounds the entire feed bin chute assembly and the tops of the feed bins 6 of one furnace. A similar feed bin enclosure 12 is provided for each furnace. The base of the feed bin enclosure 12 commences at the top of the feed bins 6 and tightly encloses the top of the feed bins through openings in the base of the feed bin enclosure 12 so that the top of the feed bins are open only into the enclosure 12. Located entirely within the confines of the feed bin enclosure are the seven feed bin chutes 4 that are used to fill the appropriate feed bins below. The common trough 2 on top of the feed bin chutes 4 is enclosed in a tight fit through an opening in the roof or upper surface of the feed bin enclosure 12, which opening in the roof permits feed to enter the top of the trough 2 feed bin chutes 4 through the roof of the feed bin enclosure 12. The result of this enclosure 12 is to contain any dust or gases that emanate from the feed bins 6 per se, and also to contain any dust which is evolved when the feed passes from the feed bin chutes 4 into the feed bins 6 as a result of the filling process.

Two long outlet slots 14 are located in the roof of the feed bin enclosure 12 and are attached to ductwork 16 which transports the gases and dust by means of introduced air which acts to transport the gases and dust through the ductwork 16 to a fabric dust filter unit 18, e.g., a baghouse which separates the dust from the gases. A fan 22 attached to the opposite side of the baghouse 18 pulls the separated air and gases through from the baghouse 18 and out through a stack 24. The feed bin enclosure 12 and the ductwork to the baghouse 16 is termed the primary collection system because of the relatively high percentage of particulates and of gases which are collected in the system and which requires special treatment of the gases in the ductwork 16 before they reach the fabric dust filter unit 18, normally termed the baghouse.

The feed bin enclosure 12 can be quite large, for example 40 feet by 40 feet by 9 feet, and is constructed of structural steel plate. Two opposing sides of the feed bin enclosure, for example the east and west sides, are permanently closed, while the other sides, for example the north and south sides, are provided with guillotine type venting dampers 26. These guillotine dampers 26 are located on the north and south sides of the feed bin enclosure 12 and are slideable sections covering openings in the feed bin enclosure 12 such that under upset conditions when these dampers 26 are pulled upwards in slideable guides on the face of the feed bin enclosure 12, the major portions of the entire north and south sides of the feed bin enclosure 12 are completely exposed to the air allowing any fumes or dust to escape from the enclosure 12 through the openings resulting from raising the dampers 26. The specific construction of the guillotine dampers 26 is not critical so long as one or a plurality of sections can be moved together to open the north and south faces of the enclosure 12 when necessary. It is sufficient if the dampers 26 can readily slide up to open the openings in the north and south face of the enclosure 12 when signaled.

These guillotine venting dampers 26 are provided to perform a number of functions. The first is to control the rate of air sweep which is admitted into the enclosure 12. For this purpose a long horizontal opening or slot (not illustrated) is provided in the upper face of the north wall venting dampers. The slot opening width may be adjusted to accommodate the required inlet air velocity necessary to safety handle the dust and gases which are collected in the feed bin enclosure. In the present case, the air sweep slot is on the upper face of the north wall venting damper 26 while the outlet opening slots 14 are in the ceiling along the south end of the feed bin enclosure 12, thereby allowing air introduced through the north wall venting damper to sweep through the enclosure 12 before exiting from the top of the south end of the enclosure 12 through openings 14 into the ductwork system 16.

The guillotine dampers 26 are also designed to be lifted, thereby exposing the north and south sides of the feed bin enclosure to the outside air, in order to permit natural ventilation of the gases inside the enclosure if the carbon monoxide concentration with the enclosure 12 approaches a preset limit, or if the temperature of the discharge gases in the enclosure 12 increases beyond a preset temperature. In the first instance, the carbon monoxide concentration must be maintained low to prevent combustion of the gases, and in all cases must be maintained lower than the explosion limit (about 12.5% for carbon monoxide) of carbon monoxide in the gas stream. Further, the temperature of the discharge gases must be maintained below that temperature at which they will damage the fabric material in the dust filter unit 18 (maximum of about 425° F. for cloth filters). To assure that the guillotine dampers 26 rise and vent the feed bin enclosure at the proper time both carbon monoxide and temperature sensors are installed at the outlet openings 14 of the enclosure that is connected to the exit ductwork 16. In general, the carbon monoxide sensor will lift the dampers when the carbon monoxide concentration reaches 2% or more, while the temperature sensor will lift the dampers when the temperature of the gases within the enclosure reaches 375° F. or more.

In conjunction with the guillotine damper operation described above, if the temperature within the feed bin enclosure 12 reaches 375° F. or more, there is also automatically actuated a hot gas isolation damper 28 on the enclosure ductwork 16, which damper closes to prevent gases from exiting from the enclosure 12 and through the ductwork 16 to the fabric dust filter units 18. The isolation damper 28 also will activate when the carbon monoxide level exceeds 2% and the guillotine dampers 26 are automatically lifted. In either case the isolation damper 28 prevents either excessively hot or potentially explosive gases from being conveyed from the feed bin enclosure 12 to the fabric dust filter unit 18.

In addition to the operation of the guillotine dampers 26 and the isolation damper 28, an air dilution damper 30 located downstream from the hot gas isolation damper 28 also is activated and permits fresh air to be sucked into the ductwork 16 and into the fabric dust filter unit 18. The opening of the air dilution damper 30 serves two functions. First, the atmospheric air cools any hot gases which are present in either the ductwork 16 or the dust filter unit 12 so that the gas temperature will be lowered to an acceptable level. The introduction of air through the air dilution damper 30 also has the effect of diluting the gas stream which is present in the ductwork 16 in the dust filter unit 18 and thereby lowers the concentration of carbon monoxide so that it cannot reach or exceed its explosion concentration. In effect, the air dilution damper 30 allows the air to purge the duct system 16 of hazardous gases and lower the temperature of existing gases out of the danger zone. Once the upset condition has been corrected and the temperature or carbon monoxide concentration has reached acceptable levels, the procedure is reversed and the guillotine dampers 26 are lowered, thereby closing the feed bin enclosure 12. The hot gas isolation damper 28 is opened to allow gases from the enclosure 12 to pass through the ductwork 16 to the dust filter 18 and the air dilution damper 30 is closed so that no air enters into the ductwork 16 as the gases are conveyed to the dust filter unit 18.

Another feature of the feed bin enclosure 12 is the provision on each face of the guillotine dampers 26 with hinged explosion release panels 32. These panels 32 will open under a lower pressure than the structural design pressure of the feed bin enclosure 12. These explosion relief panels 32 are designed to open under a maximum pressure of about 1.0 psig. The design criteria for these explosion panels 32 are about 0.75 psig±0.25 psig. These explosion relief panels 32 are mounted within the slideable sections of the guillotine dampers 12 to assure that if a detonation ever takes place within the feed bin enclosure which is due to malfunction of, for example, the knife valves 10 in the furnace feed chutes 8, the carbon monoxide sensors, or of the guillotine dampers 12, etc., these explosion relief panels 32 will open and inhibit any shock wave resulting from uncontrolled burning within the feed bin enclosure 12 from traveling through the ductwork 16 system and to the dust filter 18 with potential damage to personnel or to the collection and conveying equipment. The explosion relief panels 32 with this very low opening pressure are also mounted at given intervals in the primary ductwork 16 which carries the dust and gases to the dust filter 18. The explosion relief panels 32 are made up in accordance with the structure set forth in FIG. 3. The blow-out panel itself is preferably made out of a light but strong material such as fiberglass reinforced plastic (FRP).

Figure 3:
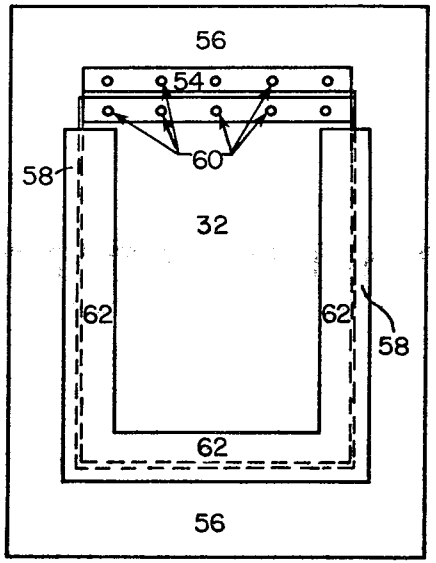
FIG. 3 is a schematic of the explosion relief panels.
Figure 3:
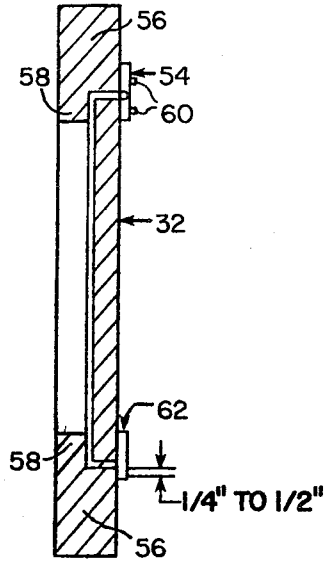

The blow-out panel 32 is preferably hinged on one edge with a heat resistant hinge 54 such as a polypropylene hinge to prevent the blow-out panel 32 from being separated from the frame 56 in which it is set. This hinge construction has two objectives. The first is to avoid the problems of blown panels 32 striking personnel or equipment, causing possible injury, and the second objective is to facilitate restoring the blow-out panel 32 to its normal state after the panel 32 has blown. Accordingly, while the hinge 54 is not essential to the blow-out purpose of the panel, it is desirable and preferred in practice to facilitate resetting of the panel 32 and to stop any blown panels 32 from being projected through the air. The blow-out panel 32 rests in a fiberglass reinforced plastic frame 56 (FRP frame) having a ledge 58 in back of the panel to prevent the panel 32 from moving inwardly. Since the operation of the primary collection system operates with a negative pressure in the feed bin enclosure 12 and in the conduits 16, the ledge portion 58 of the FRP frame 56 is essential to prevent the blow-out panel 32 from swinging into the enclosure 12 or ductwork 16. In order to secure the blow-out panel 32 to the frame 56 at the hinge 54, bolts 60 are placed through the hinge 54 both in the FRP frame 56 and in the FRP blow-out panel 32 as shown in FIG. 3. In order to hold the blow-out panel 32 secure against the frame 56 so that it will open at the designated pressure, preferably the three unsecured sides of the FRP panel 32 are taped to the FRP frame 56 by means of a weather resistant tape 62 such as a 3M® polyester tape or a Teflon® tape, each preferably having a nominal width of two inches. The tape 62 is applied so that the width of the tape 62 that extends beyond the blow-out panel 32 and onto the frame 56 is between $\frac{1}{4}$–$\frac{1}{2}$ inch in width. The above dimensions are applicable when the above designated tapes are employed. Obviously, if other tapes are used, the exact dimension will have to be determined to permit opening at a predetermined pressure. In the construction of these blow-out panels 32, it is mandatory that the panel 32 clear the frame 56 by a sufficient amount that no binding takes place by virtue of any contact of the blow-out panel 32 against the sides of the frame 56. In general, a distance of at least 1/16 inch between the panel 32 and the frame 56 will assure sufficient clearance so that the frame 56 will not interfere with the proper opening of the panel 32. When the panel 32 is assembled, it is mandatory that the surfaces of both the frame 56 and the blow-out panel 32 over which tape 62 is being applied be carefully cleaned to assure no residue remains which would interfere with the holding power of the tape. Explosion relief panels were constructed which had 12"×12"×¼" blow-out panels fitted into 14"×14"×⅜" FRP frames 56 and held together with a polypropylene hinge, gave blow-out pressures that were uniform and within the tolerances of 0.75 psig±0.25 psig, the design criteria for these panels 32. The design is extremely simple, but both functional and dependable. Further, the resetting of these panels 32 is quite simple since it merely requires cleaning the surfaces of the FRP frame 56 and FRP blow-out panel 32 where the tape 62 had been previously applied and simply reapplying fresh tape 62 so that the edge of the tape 62 which adheres to the FRP frame 56 has a width which will meet the design criteria for the panel 32 to blow out. As stated previously, the precise width of the tape 62 which adheres to the FRP frame 56 must be determined in accordance with the specific tape 62 that is employed and the blow-out pressure that is desired. For example, when utilizing polyester tape, if the tape width on the FRP frame 56 is reduced from ½ inch to ¼ inch, the pressure for blowing the panel 32 has been found to be reduced by about 25%. However, if Teflon ® tape is used instead of polyester tape, reducing the width of the tape on the FRP frame 56 from ½ to ¼" has been found to reduce the blow-out pressure by about 60%.

The following are the results of testing which has been carried out with the explosion relief panels 32 having a size of 12"×12"×¼" in FRP fiberglass frames 56 having a size of 14"×14"×⅜" and having a configuration set forth in FIG. 3. The blow-out panels 32 were hinged at the top or the bottom with a 2½"×12"×⅛" polypropylene hinge 54 on the outside face of the blow-out panel 32. The polypropylene hinges 54 were fastened with ten ½"×1" steel bolts 60 to the frame 56 and panel 32. Two tapes 62 were used in the test work, a 3M ®#8450 polyester sealing tape, 2 inches wide, and a Teflon ® tape with nominal width of 2". Each of these tapes were fastened on the three free sides of the blow-out panel 32 extending over onto the frame from ½ to ¼ inch as set forth hereafter.

Two explosion relief panels, described above, were located in a 3'×4'×¾" plywood frame that formed the front face of a 31.53 cu. ft. test chamber. The chamber had dimensions of 3'×3'×4' and was fitted with tungsten electrodes, a pressure transducer (Teledyne Taber) and a gasport entry. The test chamber was placed in a 24" thick reinforced concrete barrier with top and back barricade faces open.

The experimental procedure used to test the panels was as follows. A known pressure differential of propane gas was added from a 35.7 liter cylinder into the test chamber through a gas mixing port. Ignition of the propane-air mix was initiated by Tungsten electrodes, which entered and extended from the back of the test chamber about 14" into the chamber and were located 13" from the chamber bottom. The ignition pulse and system pressure transients during ignition and venting were recorded continuously with a Honeywell 2106 Visicorder. A standard super 8 movie camera was used to document the experimental results. All test results were carried out at 65°±5° F. in dry weather. On the basis of the evaluations performed on these test panels, which data is set forth in Table I below, it is concluded that the test panels operate reliably and reproducibly.

TABLE I

| | | Summary of Venting Characteristics* Basis: Propane-Air Mixtures | | | | | |
|---|---|---|---|---|---|---|---|
| Sealing Tape | Sealing Width** | No. of Panels | No. of Runs | Venting Pressure psig Mean | Venting Pressure psig Std. Dev. | Time to Open, Seconds Mean | Time to Open, Seconds Std. Dev. |
| Polyester | Full | 2 | 6 | 1.07 | 0.093 | 0.112 | 0.013 |
| Polyester | Full | 1 | 2 | 0.82 | 0.028 | 0.165 | 0.007 |
| Polyester | Half | 2 | 5 | 0.224 | 0.054 | 0.084 | 0.021 |
| Polyester | Half | 1 | 4 | 0.175 | 0.010 | 0.140 | 0.023 |
| Teflon | Full | 2 | 6 | 0.737 | 0.086 | 0.202 | 0.029 |
| Teflon | Full | 1 | 3 | 0.65 | 0.061 | 0.437 | 0.060 |
| Teflon | Half | 2 | 3 | 0.48 | 0.069 | 0.207 | 0.112 |
| Teflon | Half | 1 | 9 | 0.373 | 0.059 | 0.308 | 0.148 |

*Venting pressure is the pressure at which at least one panel opens.
**Full - ½" seal; Half - ¼" seal Interestingly, the venting of one panel generally appears to occur at a lower vent pressure than both panels venting together, and time for opening of the vent panel is significantly longer. These results may be interpreted to indicate that if one panel opens at a pressure of 12%–27% less than both panels, only one panel will adequately vent the test chamber.

The gases that are collected in the feed bin enclosure 12 and which are conveyed through the ductwork 16 to the fabric dust filter unit 18 contain variable amounts of water, from about 0.6 to about 3.0% by weight, based on the weight of the feed. The air that enters into the feed bin enclosure 12 to supply the air stream necessary to convey the dust and gases from the feed bins 6 to the baghouse 18 also introduces water into the system. This water can come from the atmospheric moisture in the air or from water vapor that is released in the air from around the plant and which finds its way into the feed bin enclosure with intake atmospheric air. When the water-laden air is introduced into the feed bin enclosure, water condenses in the feed bin enclosure 12 under certain conditions and the water vapor flows out with the dust and gases into the ductwork 16 and thence to the fabric dust filter unit 18. The results of this mixture of water and dust in the dust filter 18 is the formation of a wet mud that clogs the filters and requires replacement of the filter units.

In accordance with one of the features of the present invention, this mixture of gases and water can be handled in the dust filter unit 18 without clogging by introducing sufficient heat into the ductwork 16 and filter unit 18 of the primary collection system to maintain the water in the gases above its dew point. This is achieved in accordance with the present invention by the system set forth in FIG. 4 which is a small section of the primary ductwork connecting the feed bin enclosure 12 with the dust filter unit 18. The ductwork 16 can be heated by either of the systems set forth in FIG. 4. In the first system shown in FIG. 4A, the ductwork 16 is surrounded by a jacket 16A into which steam or hot gases are introduced. The hot gases heat up the ductwork 16 and this heat is radiated and/or conducted into the interior of the duct 16 to heat the gases therein. This system is operative provided that the amount of heat required is such that, if the source of heat is steam, the steam pressure required is relatively low so that the inner ductwork does not have to be made of heavy gauge material which would add to the cost of fabrication and difficulty of heat transfer. If the heat requirement is low, the steam pressure required to supply that heat would be correspondingly low and the ductwork 16 could be made of thin gauge metal which facilitates heat transfer through the inner wall of the ductwork 16.

However, where the amount of heat which is required will be variable and in some instances will require large amounts of heat inputs, the preferred system is that set forth in the other embodiment shown in FIG. 4B wherein the ductwork 16 is wrapped with heating wire 16B. The heating wire 16B is in direct contact with the surface of the ductwork, and a conductive metal foil 16C a few mils thick, such as aluminum foil, is adhered to the surface of the ductwork with a high temperature resistant adhesive. The foil 16C is wrapped over the heating wire 16B so that the foil adheres to the surfaces of the ductwork 16 and the heating wire 16B, but always conforming to the shape of, and in contact with, the surface of the ductwork 16 and heating wire 16B. The combination of the heating wire 16B and the foil 16C increases heat absorption within the ductwork 16 immensely so that any water which flows through the conduit is maintained above its dew point at all times and, therefore, can pass through the dust filter unit 18 without forming a mud with the dust and blinding the filter unit 18. To prevent concentration of water vapor within the dust filter 18, this also is provided with similar heating units. Since the heating wire 16B can be heated to various temperatures, depending on the amount of electric current which is passed through the wire, the amount of heat that can be generated and absorbed by the gas stream can be varied to meet the needs of a particular stream containing a given amount of water vapor to maintain the water at above its dew point in the stream. This flexibility is most important where there are different temperature conditions and different atmospheric water vapor conditions which can affect the dew point.

Figure 4:
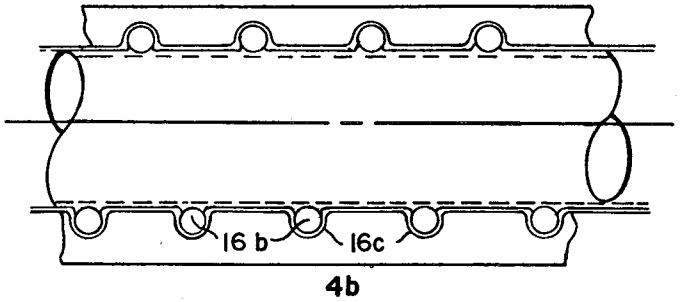
FIG. 4 is a section of one of the ductworks that carries both gases and particulates from the collection area to the dust filter unit.
Figure 4:
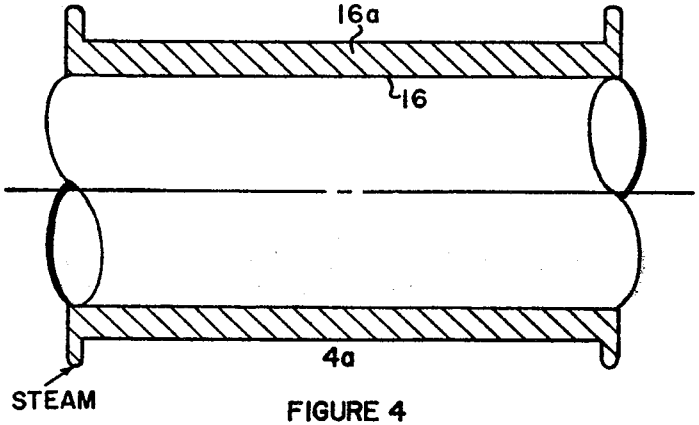

In either case, the embodiments of FIG. 4 are always wrapped with additional insulation (not shown) over either the steam jacket 16A or over the foil 16C that encases the ductwork 16 and the heating wire 16B which surrounds the ductwork 16 in order to prevent heat, which is generated in the heating jacket or by the heating wires, from escaping into the atmosphere. It should be noted that in the present system the heat that is generated by either the heating jacket 16A or heating wire 16B is used to heat the interior contents of the ductwork 16 so that the gases are raised and maintained above their dew point when they are conveyed from the feed bin enclosure 12 to the dust filter unit 18. In effect, the gas in the ductwork 16 is being heated by this technique to a temperature above its dew point. This is in distinct contrast with some prior art systems that have used heating means interposed between feed bins and the exterior cold in order to set up an intermediate warm air zone to prevent water vapor from condensing in the feed bins. This latter technique is termed an "oven effect" in which the feed bins are surrounded by warmed air to create a cushion of warmth between the outside cold and the feed bins in the hope of preventing condensation of the water vapor. This prior system has not been found wholly effective, whereas the system set forth in the present invention has been found eminently successful to control water vapor condensation in the dust filter unit 18 to such an extent that little or no pluggage or blinding of the dust filter unit 18 has been found to occur when the ductwork 16 is heated in accordance with the present invention and particularly with the preferred embodiment wherein heating wire 16B and foil 16C are employed as set forth above.

In addition to the primary collection system described above, there is a secondary collection system which is designed primarily to collect dust which is generated in the transportation and handling of the feed. This secondary dust collection system, shown in FIG. 2, is made up of a hood 34 which completely covers conveyor C-14 over its entire length. Collection air ducts (not shown) come off the top of this hood at periodic pickup points. In addition, the shuttle conveyor C-15 is hooded at 36 over its entire length to pick up any dust generated when conveying the feed on the conveyor belt. Further, there are tunnel dust hoods 38 over the feed troughs 2 and feed bin enclosures 12 with ducts 40 positioned in the center of the roof of the hoods 38 to remove the dust and convey it to a second baghouse (not shown). The tunnel dust hoods 38 are located one per furnace in order to take up the dust load which is formed when the feed falls from the conveyor C-15 into the top of the troughs 2 and feed bin chutes 4 and generates dust. In addition, some dust which is within the feed bin enclosure 12 sometimes will rise through the feed bin chutes 4 and up into the tunnel dust hood area 38.

The ductwork 42 from the tunnel dust hood 38 and also from the hoods 34 and 36 over conveyors C-14 and C-15 all contain blow-out panels 32 at periodic spacings in the length of the ductwork 42 and the dust in this ductwork 42 is conveyed to a separate baghouse (not shown) from that used in the primary collection system. The baghouse for the secondary collection system also is equipped with blow-out panels. Since the gas stream which is sucked into the secondary collection system is essentially dust and ambient air with very little moisture from the feed bins 6 or feed bin enclosure 12, the ductwork 42 of the secondary collection system does not have to be heated before entering the baghouse of the secondary collection system. The baghouse or dust filter unit of the secondary collection system also has a fan on the opposite side of the baghouse from the ductwork 42 to convey air through the baghouse and out through a stack in the same manner as the primary collection system. In this way, a negative pressure is always applied in the hoods 34 and 36, tunnel dust hoods 38, and secondary collection ductwork 42 leading to the secondary baghouse.

Another embodiment of the present invention is the use of an inert gas stream to maintain safe operations in the feed bin and the feed bin enclosure. As shown in FIG. 2, an inert gas is injected into the furnace feed chutes 8, both above via line 44 and below via line 46 the knife valve 10, on a continuous basis. The inert gas can be any gas which is noncombustible and which contains less than 1.5% oxygen. An ideal gas stream for this purpose is boiler combustion gas after it has been cooled to appropriate temperature. The injection of the inert gas as set forth above in the furnace feed chutes 8 serves a number of purposes. Initially it keeps the carbon monoxide concentrations low by virtue of the dilution effect that it has. Secondly, it provides a "cork effect" by reducing the ability of the carbon monoxide to rise into the feed bins through the furnace feed chutes. This is because the carbon monoxide must rise up through the continuous "cork" of inert gas before it can reach the feed bins. The inert gas also has the benefit of reducing any fusing of the feed in the feed bins due to the burning of coke or other combustible materials in the feed. Such coke combustion can result in fusing of the feed into large agglomerates that will not feed down the furnace feed chutes.

As we stated previously, a knife gate 10 will close if no feed is present in the furnace feed chutes as evidenced by a low-low level sensor. When this occurs, the inert gas which enters above the closed knife valve 10 via line 44 will dilute any carbon monoxide or phosphorus gases that may be present in the furnace feed chute 8 so as to diminish the chances of these gases burning. In similar manner, the inert gas which is injected below the knife valve 10 via line 46 will force any carbon monoxide and any phosphorus vapor to be diluted with inert gas and be forced down into the furnace so as to minimize any burning or uncontrolled explosion within the furnace feed chutes 8 below the knife valve 10. The injection of inert gas in the system is essentially self-adjusting because the inert gas chooses the path of least resistance. Accordingly, if we assume that most furnace feed chutes are filled with feed material, more gas is diverted to the empty chutes where there is a higher risk of larger carbon monoxide concentrations because of lack of resistance to the flow of gas through the feed chutes and up into the feed bins.

While the present invention has been described chiefly with reference to the production of phosphorus in an electrical furnace, it should be understood that the features of the present invention are equally suitable for use with other particulate and gas collection systems even where furnace operations may not be involved; however, they are especially suitable where electric furnace operations are employed such as in the manufacture of nickel, chromium, calcium carbide, tungsten carbide, and ferro-alloys such as ferro-silica, ferro-manganese, ferro-chrome, and the like which are produced in electrometallurgical furnaces, and in the direct reduction of iron ore in electric furnaces.

What is claimed is:

1. A process for feeding a furnace with furnace feed and collecting the dust created by the feeding process which comprises positioning a reversible shuttle conveyor over feed bin chutes, feeding material from said conveyor into said feed bin chutes in sequential order until a feed bin sensor in each feed bin indicates the feed bin is full and forwards said conveyor to the next feed bin chute requiring filling, passing the feed material into feed bins located below the feed bin chutes until they are full, collecting the dust formed about the feed bin chutes and feed bins in an enclosure surrounding the feed bin chutes and feed bins, conveying the dust and gases within said enclosure through exhaust openings in the enclosure to a duct, heating the duct and the dust and gases therein sufficiently to maintain the dust and gases at above the dew point, conveying the gas stream to a separator, separating the dust from the gases, and discharging the gases from the separator.

2. A process for feeding a furnace with furnace feed and collecting the dust created by the feeding process which comprises positioning a reversible shuttle conveyor over each of a plurality of initial feed bin chutes on one side of the conveyor, feeding material from one side of said conveyor into said initial feed bin chutes in sequential order until a feed bin sensor in each feed bin which is connected to the feed bin chute indicates the feed bin is full and forwards said conveyor to the next feed bin chute requiring filling until all the initial feed bins on the same side of said conveyor are full, shuttling the said conveyor in an opposite direction from that previously traveled so that the opposite end of said conveyor from that previously used for feeding the prior filled initial feed bins is positioned over the first of a second series of feed bin chutes, feeding material from said opposite end of said conveyor into the second series of feed bin chutes in sequential order until a feed bin sensor in each feed bin indicates the feed bin is full, collecting the dust and gases about the feed bin chutes and feed bins in an enclosure surrounding the feed bin chutes and a portion of the feed bins, conveying the dust and gases collected within said enclosure through exhaust openings in the enclosure to a duct, maintaining said enclosure and duct under subatmospheric pressure, introducing heat at a sufficient rate into said duct to maintain the gases therein at above their dew point, conveying the gases and dust in said duct to a separator maintained at subatmospheric pressure, separating the dust from the gases in said separator without substantial condensation of any of the water vapor in said gases, discharging said gases from said separator, and collecting the separated dust for disposal separate from said gas stream.

3. Process of claim 2 wherein said furnace is a phosphorus-producing furnace, said feed in a mixture of calcined phosphate agglommerates, carbon and silica, and said dust collected about said feed bin chutes and feed bins comprises particulates resulting from breakdown of said feed.

* * * * *